United States Patent [19]

Hoppie

[11] Patent Number: 4,582,475

[45] Date of Patent: Apr. 15, 1986

[54] METHOD AND APPARATUS FOR IGNITING COMBUSTIBLE MIXTURES

[75] Inventor: Lyle O. Hoppie, Birmingham, Mich.

[73] Assignee: Eaton Corporation, Cleveland, Ohio

[21] Appl. No.: 446,796

[22] Filed: Dec. 3, 1982

Related U.S. Application Data

[63] Continuation of Ser. No. 163,854, Jun. 27, 1980, abandoned.

[51] Int. Cl.[4] ..... F23Q 21/00

[52] U.S. Cl. ..... 431/6; 431/255; 431/263; 431/264; 123/536; 123/537; 123/538; 123/539

[58] Field of Search ..... 431/2, 4, 6, 8, 263, 431/264, 265, 258, 255; 123/539, 538, 537, 536; 60/275

[56] References Cited

U.S. PATENT DOCUMENTS

| | | | |
|---|---|---|---|
| 3,841,824 | 10/1974 | Bethel | 123/536 |
| 4,077,374 | 3/1978 | Willmann et al. | 123/536 |
| 4,091,779 | 5/1978 | Saufferer et al. | 123/536 |
| 4,124,003 | 11/1978 | Abe et al. | 123/536 |

*Primary Examiner*—Samuel Scott
*Assistant Examiner*—Carl D. Price
*Attorney, Agent, or Firm*—C. H. Grace; J. G. Lewis

[57] ABSTRACT

A combustible mixture composed of a flowing fuel and gaseous oxygen is ignited by exposing one or both of the constituents of the mixture to a region of corona discharge in order to generate molecular radicals which subsequently combine with radicals of the other constituent to initiate combustion. The apparatus includes at least two electrodes (14 & 16) having a voltage potential impressed thereacross to generate a region of intense electric field and means to maintain the resulting voltage-current characteristic relationship within a corona discharge region of operation (42).

8 Claims, 5 Drawing Figures

FIG. 4.
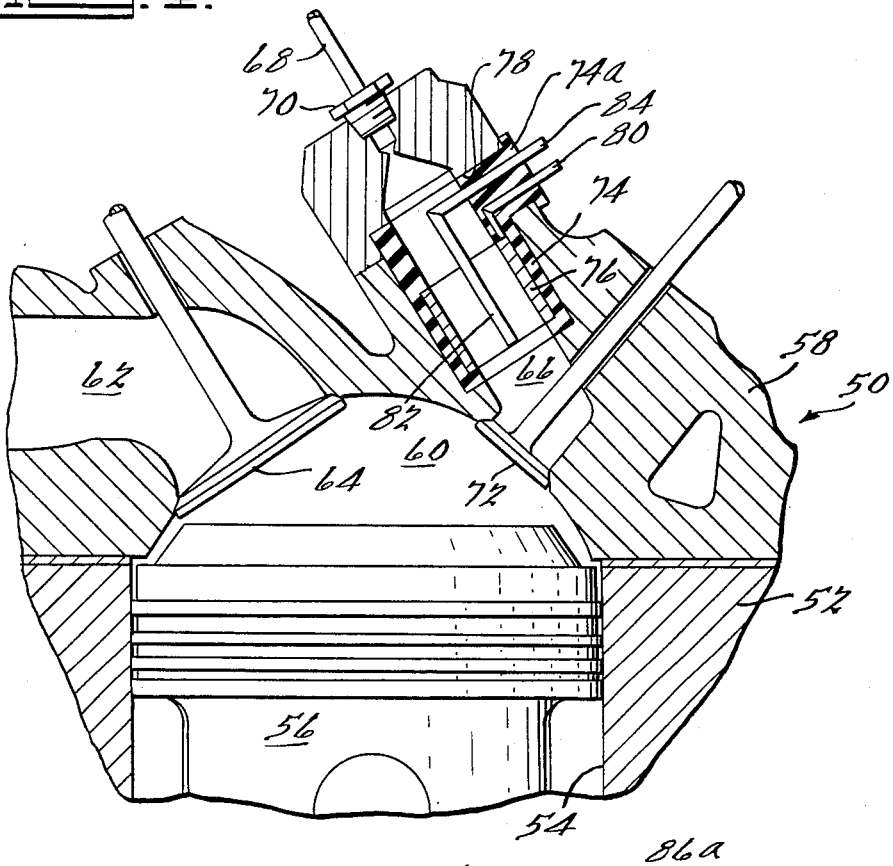
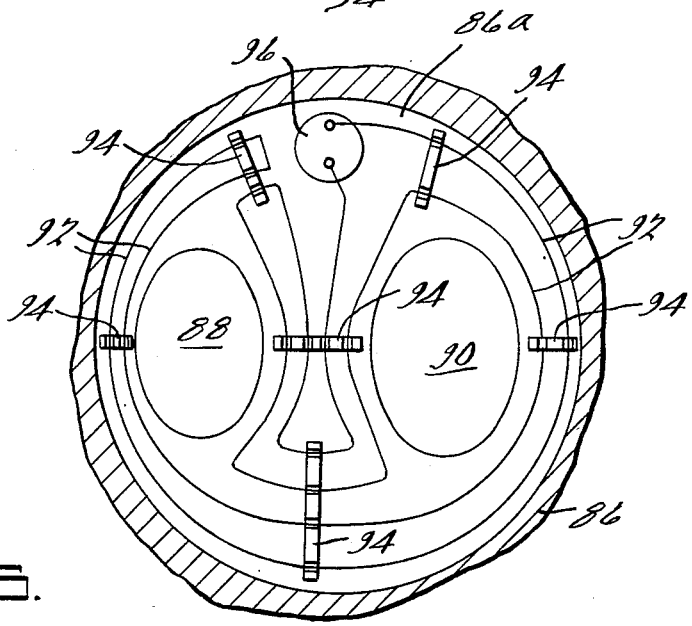
FIG. 5.

METHOD AND APPARATUS FOR IGNITING COMBUSTIBLE MIXTURES

This is a continuation of application Ser. No. 163,854 filed June 27, 1980 now abandoned.

INTRODUCTION

This invention relates to method and apparatus for igniting combustible mixtures and specifically to such methods and apparatus which involve precursory molecular modification of the constituents of combustion.

BACKGROUND OF THE INVENTION

Flowing hydrocarbon fuels and gaseous oxygen have received essentially universal application as the constituents of combustion in heat engines and various gas appliances (clothes dryers, furnaces, hot water heaters, ovens/ranges and the like). In such applications, the constituents of combustion (which are defined generically as fuel and an oxidizing agent) are combined into a flowing mixture which is ignited by the application of a mechanism which imparts electrical spark discharge energy, thermal energy from a radiant body, chemical catalytic reaction or by elevating the temperature and pressure of either or both constituents. The fuels most commonly employed are gasoline, fuel oil, methane, propane, ethane, and butane. These fuels combine with the oxidizing agent (which is most commonly gaseous oxygen found in air) to maintain an exothermic reaction once acted upon by the ignition mechanism which initiates such an exothermic reaction.

Of the various types of igniters in use, the electric spark type has gained wide acceptance. Spark plug ignition systems are used almost exclusively in internal combustion engines. Additionally, household type applicances are frequently redesigned to substitute spark igniters for systems employing continuously burning pilot lights as an energy conservation measure.

Although spark ignition of hydrocarbon fuels is a common practice, commercially available devices have a number of characteristic short-comings which vary in significance from application to application. Any electric spark effected across an air gap requires relatively high levels of power (product of voltage and current) which can present a shock hazard as well as a risk of inadvertant conflagration when employed in the vicinity of volatile fuels. Furthermore, sparking devices tend to radiate electromagnetic energy at high frequencies, and exhibit life shortenings because of metal migration between the electrodes. Maintenance of spark gap dimensions is often critical to the operation of prior art devices, necessitating relatively frequent inspection and/or servicing.

An additional shortcoming of spark igniters resides in the fact that a spark, once established between two electrodes, is a highly localized phenomenon. When a spark is employed to detonate a mixture of fuel and oxidizing agent within a combustion chamber, for example, the flame front of burning a mixture must propagate outwardly from the localized spark to envelope the entire chamber. In certain applications, this propagation time can be relatively long and result in incomplete combustion and inefficient operation of the associate device. In certain other applications, particularly when the mixture has less than the stoicometric amount of fuel, the flame front originating from the localized spark may quench, i.e., the flame front may cease to propagate and combustion may terminate prematurely.

It will become apparent from a reading of the specification that the present invention may be advantageously utilized in many different applications requiring the combustion of hydrocarbon fuels and oxidizing agents. However, the invention is especially useful when employed with household type appliances. Accordingly, the preferred embodiment of the invention will be described in that environment. Additionally, the present invention is also useful in application with internal combustion engines, and two alternative embodiments of the invention will be described in connection therewith.

The concept and characteristic operation of corona discharge devices are generally well known in other areas such as lasers, flame sensors, and smoke detectors. A widely used commercial application of corona discharge tubes is in Geiger counters.

BRIEF DESCRIPTION OF THE INVENTION

The present invention provides an extremely simple, inexpensive and structurally sound igniter of mixtures of combustion constituents, namely, fuel and oxidizing agents. The inventive method of igniting such mixtures of combustion constituents comprises the steps of establishing a region of corona discharge by impressing an electrical potential across at least two electrodes and directing a working fluid comprising at least one of the constituents of combustion through the region of corona discharge to generate molecular radicals which are combined with molecular radicals from the other of the constituents to initiate combustion. This method provides reliable ignition of mixtures of fuel and oxidizing agent at very low electrical power levels.

The inventive igniter apparatus comprises first and second spaced electrodes having a voltage potential impressed thereacross to generate a region of intense electric field, means to obtain a working fluid composed of one or both of the constituents of combustion and to expose the working fluid to the region of intense electric field to generate molecular radicals therefrom ,thereby establishing an electrical current between the electrodes. The apparatus further comprises means to combine the radicals with molecular radicals from the other of the constituents to initiate combustion, and means operative to effect maintenance of a resultant characteristic relationship of the voltage potential and current within a corona discharge region of operation. This arrangement provides the advantage of an extremely low power igniter which can be employed in a multitude of applications wherein the working fluid is fuel alone, oxidizing agent alone, or a premixed combination of the two.

According to another aspect of the invention, means are provided to electrically disconnect the source of voltage potential from across the electrodes once combustion has been initiated. This arrangement provides the advantage of additional energy savings wherein the igniter is energized only during the actual ignition process and is deenergized during self sustained combustion.

According to the preferred embodiment of the invention, the electrodes comprise an elongated metal wire disposed concentrically within a metal tube to effect distributed electric field. Such an arrangement provides simple, rugged construction of the igniter electrodes.

According to still another aspect of the invention, the cylindrical electrode is employed as a conduit for one of the constituents of combustion. This arrangement provides the advantage of an igniter which can be integrally formed within a fuel delivery system rather than as an appendix thereto.

These and other features and advantages of this invention will become apparent upon reading the following specification, which, along with the patent drawings, describes and dicloses a preferred embodiment as well as two alternative embodiments of the invention in detail.

The detailed description of the specific embodiments makes reference to the accompanying drawings.

BRIEF DESCRIPTION OF THE DRAWINGS

FIG. 4 illustrates a cross-sectional view of a typical internal combustion engine cylinder and head incorporating a first alternative embodiment of the present invention; and FIG. 5 illustrates a broken sectional view of a head of an internal combustion engine incorporating a second alternative embodiment of the present invention.

DETAILED DESCRIPTION OF THE PREFERRED AND ALTERNATIVE EMBODIMENTS OF THE INVENTION

Figure 1:
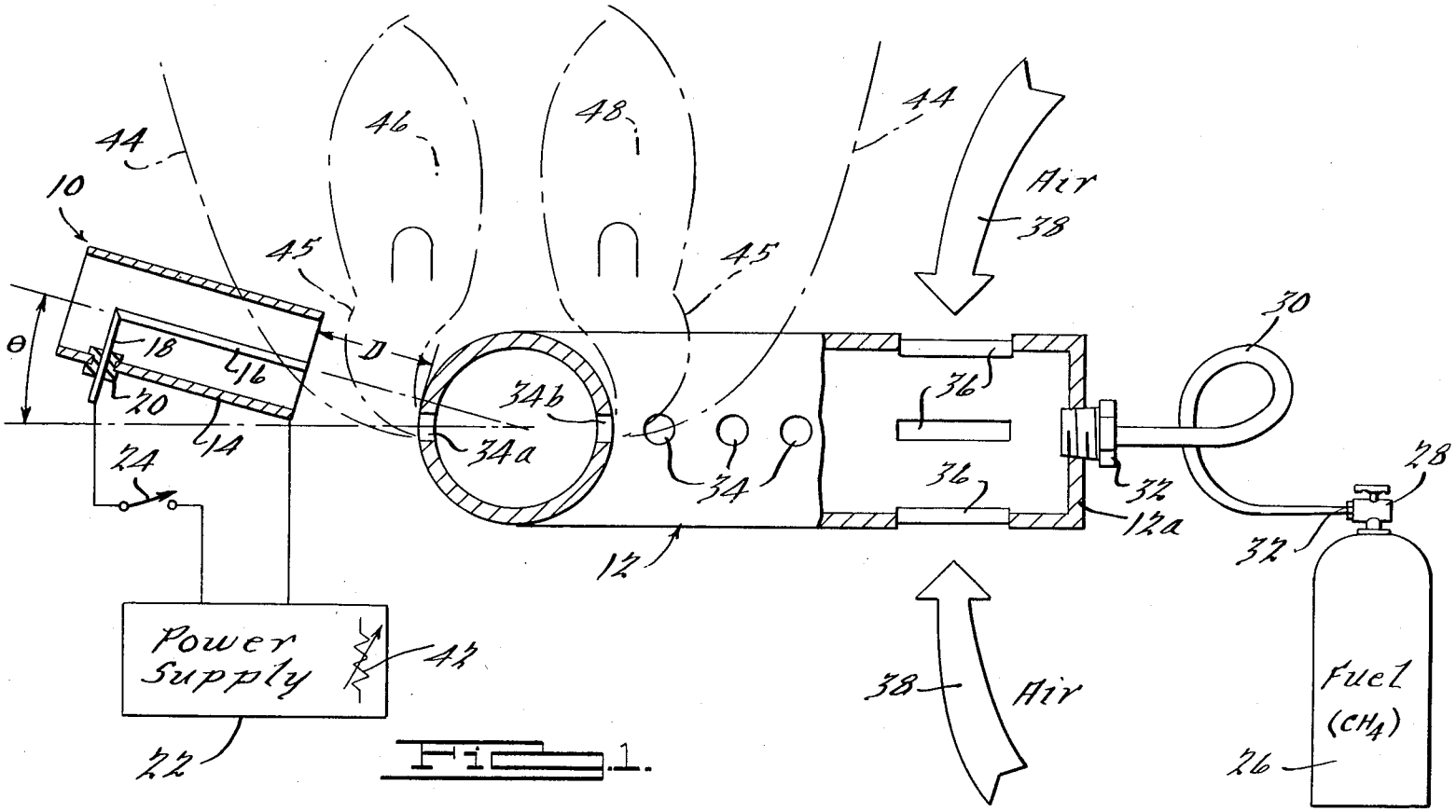
FIG. 1 is a schematic diagram of the preferred embodiment of the invention in application with a typical household gas appliance.

Referring to FIG. 1, the preferred embodiments of an inventive igniter generally designated at 10 is illustrated in application with the manifold 12 of a typical household appliance. FIG. 1 is illustrated schematically to eliminate unnecessary details which are not relevant to the present invention.

Igniter 10, includes a first cylindrical electrode 14 which is constructed of electrically conductive metal such as aluminum, stainless steel or other suitable material. A second electrode 16 is formed from an elongated conductive wire and is disposed concentrically within electrode 14. Electrode 16 extends coaxially substantially the entire extent of electrode 14. Electrode 16 integrally depends from a support piece 18 which is formed at right angles thereto and passes radially outwardly of electrode 14 through an insulating grommet 20. A power supply 22 is electrically connected directly to electrode 14 and interconnected to electrode 16 through a switch 24 and support piece 18. When switch 24 is closed, power supply 22 operates to apply or impress a voltage potential across electrodes 14 and 16. Switch 24 can be manually operated to electrically disconnect power supply 22 from electrode 16. The applicant has experimentally determined that a voltage level of approximately 10K volts is desirable in the embodiment illustrated in FIG. 1 and will result in approximately 1 watt of power consumption, compared with tens or hundreds of watts with prior art devices for similar applications.

Manifold 12 is intended to exemplify those typically found in household appliances such as clothes dryers, furnaces, hot water heaters, ovens and ranges, wherein a hydrocarbon fuel, typically of the alkane class (methane—$CH_4$, propane—$C_3H_8$, ethane—$C_2H_6$, butane—$C_4H_{10}$ etc.), is introduced therein from a reservior or source such as a pressurized fuel bottle 26 or through underground distribution networks. For purposes of the illustrative preferred embodiment in FIG. 1, fuel bottle 26 is illustrated as having a conventional valve and regulator assembly 28 and is interconnected to manifold 12 through a pipe 30 having appropriate fittings 32 at each end thereof.

Manifold 12 is "U" shaped (only half of which is illustrated) having a circular cross-sectional geometry and constructed of cast or drawn metal. Manifold 12 has a plurality of circumferentially spaced opposed pairs of ports 34, ports **34*a* and 34*b* constituting one pair. Ports 34 are provided through substantially the entire extent of manifold 12 with the exception of one end designated 12*a* which is associated with fitting 32 through which fuel is received into manifold 12. A plurality of circumferentially spaced air inlet ports 36 are provided near end 12*a* of manifold 12. When pressurized fuel is delivered to manifold 12 from bottle 26, it flows through fitting 32 and flows therethrough past ports 36. This flow of fuel will create a localized low pressure region and draw air designated by arrows 38 into manifold 12 through ports 36. The fuel and air 38 is then mixed within manifold 12 and distributed therethrough, ultimately merging outwardly through ports 34 along the entire extent of manifold 12. In the embodiment illustrated in FIG. 1, the atmosphere is the source of the air entering ports 36. However, it is contemplated that the air could be premixed with fuel within bottle 26** or have other sources.

Port **34*a* is, by virtue of its proximity to igniter 10, designated as the ignition port, that is the gas eminating from port 34*a* will the first to be ignited during the ignition process. Ports 34 open into the atmosphere horizontally from manifold 12. The free end of electrode 16 terminates approximately flush with one of the open ends (righthand most end as shown in FIG. 1) of electrode 14. Electrodes 14 and 16 are aligned so that their common axis intersects the axis of manifold 12 at a point laterally coinciding with the axis of port 34*a*, but displaced therefrom by an angle $\theta$. The end of electrodes 14 and 16 nearest manifold 12 is displaced therefrom by a distance D. In applications using natural gas and air, the applicant found that the minimum inner diameter of electrode 14 should be $\frac{3}{8}$ inch. The diameter of inner electrode 16 should be kept as small as possible (to help minimize required voltage level) while retaining necessary structural integrity. The length of electrodes 14 and 16** need only be enough to adequately expose the working fluid to the electric field so that enough radicals are generated to subsequently initiate combustion.

For the purposes of the present specification, working fluid is defined as the fluid or gas within which electrodes 14 and 16 are emersed. Specifically, it is the fluid which fills the volumn which interspaces electrodes 14 and 16. When switch 24 is closed, power supply 22 impresses a voltage across electrodes 14 and 16. In the present example, prior to valve 28 of fuel bottle 26 being turned on, the working fluid of igniter 10 comprises air only. When a voltage is impressed across electrodes 14 and 16, a region of intense electric field will be generated about electrode 16 which will tend to generate free electrons and molecular radicals from oxygen such as those indicated by the following equations.

$$O_2 \rightarrow 2O$$

$$O_2 \rightarrow 2O^+ + 2e^-$$

$$O_2 \rightarrow O + O^+ + e^- \quad (1)$$

Under the influence of the voltage potential across electrodes 14 and 16, and depending upon the polarity thereof, liberated free electrons and oxygen ions will migrate in opposite directions to electrodes 14 and 16 thereby establishing a current flow. Either an AC or DC power supply can be employed. When using a DC power supply, electrode 16 should be positive. A negative corona on electrode 16 has been found to be spotty or less uniform.

Figure 2:
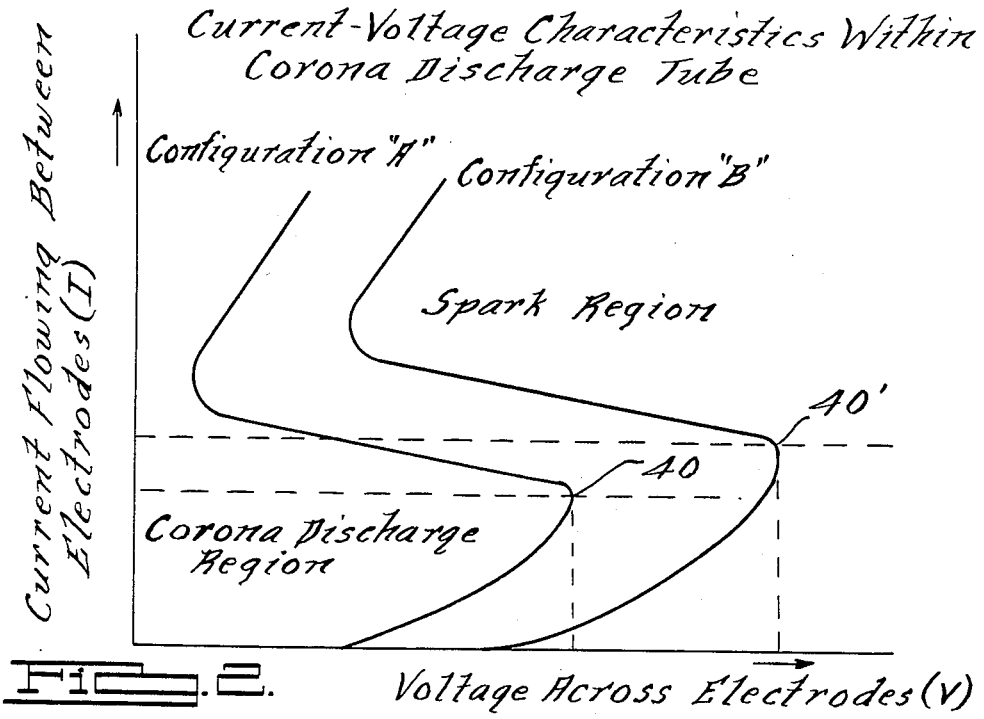
FIG. 2 is a graphical presentation of typical current-voltage characteristics within a corona discharge tube having two alternative geometrical and working fluid configurations.

Referring to FIG. 2, the illustrated configuration of the electrodes and composition of working fluid will result in a characteristic relationship between the voltage potential across the electrodes and the current flowing therebetween as designated "Configuration A". The characteristic curve relating to Configuration A will have a characteristic knee 40 which distinguishes the corona discharge region for current levels therebelow from the spark region for current levels thereabove. If the voltage level of power supply exceeds the level found at the characteristic knee of the curve, the corona discharge will cease and a localized arc will be created between electrodes 14 and 16 and resultant percipitous increase in current flow. To assure that igniter 10 operates in the corona discharge region, means are provided to maintain the voltage and current levels below knee 40. This can be effected by a variable resistor 42 within power supply 22 which operates to prevent the current flowing therefrom from exceeding the value found at knee 40.

When igniter 10 is maintained in the corona discharge region of operation, the corona discharge as well as the region of intense electric field is distributed about the volume defined by electrode 14 and will tend to generate radicals from the free oxygen found in the air.

For the purposes of the present application, fuel bottle 26 is presumed to contain methane gas ($CH_4$) which, will mix with air 38 within manifold 12 and emerge initially from port 34*a* and 34*b* in an upwardly expanding plume designated generally by dotted lines 44. Electrodes 14 and 16 are positioned with respect to manifold 12 such that the ends thereof will be emmersed within plume 44 as gas and air 38 exits port 34*a* inter alia. With the corona discharge established in air, methane molecules will tend to rise upwardly and into the cavity defined by electrode 14. These molecules will then become part of the working fluid and, passing through the region of intense electric field, will be converted into radicals, an example of such conversion being indicated in the following equation.

$$CH_4 \rightarrow CH_3 + H \quad (2)$$

At that time, radicals of both constituents of combustion i.e. fuel (methane) and oxidizing agent (oxygen) are present and will initiate combustion. The mixture of methane and air entering the lower (righthand most) end of electrode 14 will operate to displace air originally contained therein out of the upper (lefthand most) end of electrode 14. The combustion will subsequently liberate more radicals from the stable oxygen and methane molecules exiting port 34*a* resulting in a frame front designated 46. Because plume 44 is contiguous along the entire extent of manifold 12 adjacent ports 34, flame front 46 will propogate consecutively therealong until additional flame fronts 48 are established from each of ports 34 and burner function of manifold 12 is fully operative. At that point, switch 24 can be opened to deenergize igniter 10. Due to the chimney effect of flame fronts 46 and 48, a plume of smaller profile indicated by dotted lines 45 will be assumed. Electrodes 14 and 16 are so positioned as to be spaced from plume 45 and therefore will not be subjected to prolonged periods of elevated temperatures thereby prolonging the life of electrodes 14 and 16.

If the character of the working fluid or the geometrical configuration of electrodes 14 and 16 changes, the resultant characteristic relationship of the voltage potential and current will vary as designated "Configuration B" in FIG. 2. The new characteristic will have a different knee designated 40' but will maintain substantially the same shape as the characteristic associated with Configuration A. Variable resistor 42 must therefore be adjusted to compensate for shifts or changes in the current voltage characteristic. In the present embodiment, this is illustrated as a manual adjustment but it is contemplated that more sophisticated automatic compensating apparatus could be employed.

Figure 3:
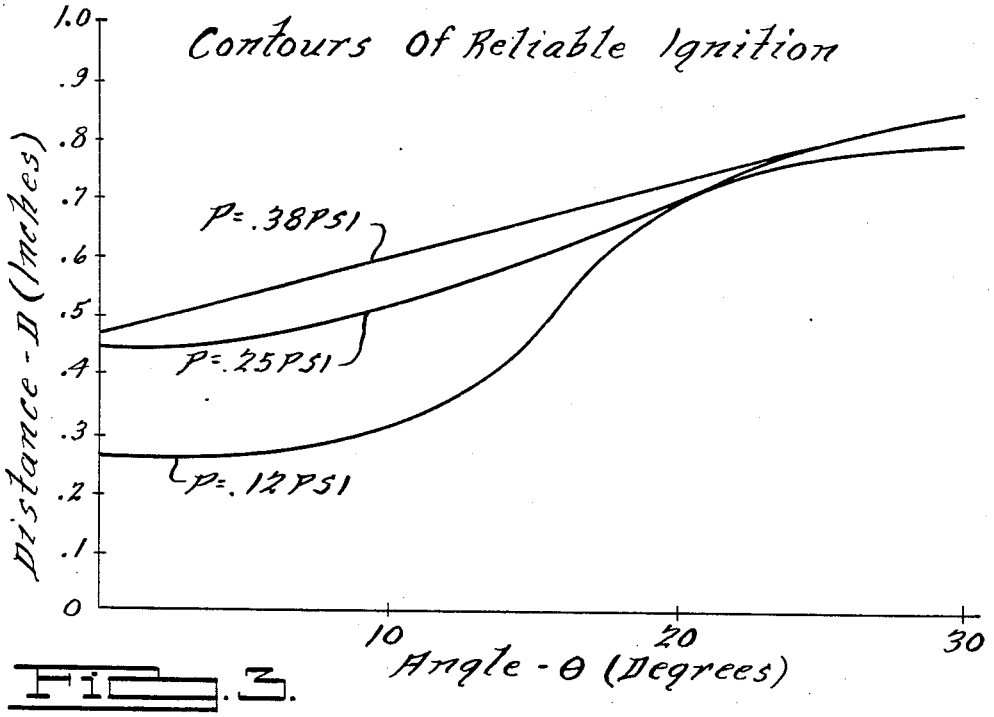
FIG. 3 is a graphical presentation of the contours of reliable ignition, in terms of distance and angular displacement of the igniter electrodes from the gas manifold of FIG. 1.

Referring to FIG. 3, typical empirically derived data is presented relating distance D with displacement angle $\theta$ for a particular apparatus employed by the applicant. The data is intended as an example only and should not be considered limiting in any sense inasmuch as different geometrical configurations will produce different optimum distances and angles.

The illustrated structure of electrodes 14 and 16 have a number of particular advantages. In addition to being inexpensive and relatively simple to manufacture, outer electrode 14 serves to protect inner electrode 16 and can be of a relatively thick section to protect it from external influences. As will be seen hereinbelow, cylindrical electrode 14 can also be employed as a conduit for one or both of the constituents of combustion.

The preferred embodiment of the invention represents a method of initiating combustion wherein the oxygizing agent (air) is the working fluid. Fuel is subsequently introduced after the corona discharge condition is established. In contrast, a first alternative embodiment of the invention illustrated in FIG. 4 illustrates an example where fuel is the working fluid which is subsequently mixed with oxygen radicals. FIG. 5 illustrates still another application in which premixed fuel and air is the working fluid with a subsequently established corona discharge.

Referring to FIG. 4 a fragmentary cross-section view of a conventional lean burn internal combustion engine 50 comprises a conventional block 52 defining a cylinder wall 54 within which is disposed a piston 56 for reciprocal displacement therein. The top of cylinder wall 54 is covered by an intake manifold 58 which defines a combustion chamber 60 in combination with the top surface of piston 56 and the portion of block 52 defining cylinder wall 54. An air intake port 62 communicates with combustion chamber 60 through a conventional inlet valve 64. A convention exhaust valve port (not illustrated) is provided and functions as is well known in the art. Heat 58 also defines a fuel inlet port 66 which receives pressurized gaseous fuels such as propane ($C_3H_8$) from a reservior or container through fuel inlet line 68 and suitable fitting 70. The end of fuel inlet port 66 opposite fitting 70 communicates with combustion chamber 66 through a fuel inlet valve 72 which would be driven by a cam or similar mechanism (not illustrated) as would be the conventional inlet and exhaust valves.

Inlet port 66 has an area of increased diameter within which is nested a cylindrical insulator 74 which itself has a region of increased internal diameter within which is nestingly engaged a cylindrical electrode 76. Insulator 74 has an integral localized extension portion 74A which passes through a bore 78 otherwise interconnecting fuel inlet port 66 and the atmosphere. An electrical terminal 80 is electrically connected to electrode 76 and is molded within insulator 74 as it passes outwardly through portion 74A thereof. A second electrode 82 is disposed concentrically within electrode 76. Electrode 82 is supported in the illustrated position by a support terminal 84 which is integrally formed with the end of electrode 82 nearest fitting 70 and which passes outwardly through portion 74A of insulator 74. Electrode 82 runs the entire extent of electrode 76 and is axially coterminous therewith. Electrodes 76 and 82 are therefore insulatively mounted within head 58 and are externally electrically accessable via terminals 80 and 84.

It is contemplated that electrodes 76 and 82 would, in application, be connected to a power supply such as that described with reference to the preferred embodiment of the invention in FIG. 1.

When an electrical potential is impressed against electrodes 76 and 82 when gaseous fuel is introduced into fuel inlet port 66, fuel radicals are generated. At the appropriate moment during each cycle of operation of engine 50, valve 72 opens, allowing the fuel and radicals to enter combustion chamber 60, combining with oxygen molecules which enter through air inlet port 62. The fuel radicals will then combine with oxygen radicals which either occur naturally or as a result of the increase energy levels of oxygen due to the residual heat within the combustion chamber or through colisions with the relatively high energy fuel radicals. The net result of the combination will be ignition.

Referring to FIG. 5 a second alternative embodiment of the invention is illustrate, also in the environment of an internal combustion engine. FIG. 5 illustrates a "pistons eye view" of an overlying cylinder head 86 including conventional inlet and exhaust valve 88 and 90 respectively. A fine electrically conducting wire 92 is insulatively mounted to the portion of head 86 defining the upper portion of the combustion chamber and is distributed thereabout upon insulating combs 94 constructed of high temperature resistant electrically insulators such as alumina or silica. Wire 92 is preferably a high temperature alloy such Inconal and is as fine as possible while still having the ability to survive the environment of the combustion chamber. A plug of insulating material 96 insulates wire 92 from head 86 while allowing external access thereto without loss of compression within the combustion chamber.

In application, the alternative embodiment illustrated in FIG. 5 would have a power supply connected to impress a voltage potential between wire 92 and head 86 which is constructed of steel or other electrically conductive material. Wire 92 is routed so that spacing from the closest adjoining of head 86 is relatively uniform. In effect, wire 92 comprises one electrode and head 86 comprises the second electrode. When an electrical potential is impressed thereacross a region of intense electric field is formed about wire 92. The net result will be a corona discharge between wire 92 and head 86 which is distributed relatively evenly throughout the entire upper surface of the combustion chamber which will result in relatively uniform or distributed combustion through the entire chamber rather than point type ignition found with conventional spark plug type ignition systems.

The alternative embodiment illustrated in FIG. 5 is an example of a case where the working fluid is premixed fuel and air which is admitted to the combustion chamber prior to the establishment of the corona discharge.

It is to be understood that the invention has been described with reference to a specific embodiment and two alternative embodiments which provide the features and advantages previously described, and that such embodiment are susceptable modification, as will be apparent to those skilled in the art. Accordingly, the foregoing description is not to be construed in a limiting sense.

What is claimed:

1. A method of igniting mixtures of combustion constituents comprising the steps of:

forming a working fluid comprising at least one of said constituents of combustion;

directing said working fluid through a flow path having a known geometrical configuration;

establishing a region of intense electric field within said flow path by impressing an electrical potential across at least two spaced electrodes to generate molecular radicals, electrons and ions from working fluid molecules within said field, wherein one of said electrode is disposed substantially adjacent a surface position of said flow path having said known geometrical configuration and said working fluid passes between said electrodes, said generation of electrons and ions effecting an electric current between said electrodes;

said molecular radicals with molecular radicals combining of the other of said constituents of combustion within said flow path to effect spontaneous sparkless ignition of the mixture without the presence of a separate ignition source; and maintaining a resultant characteristic relationship of said electrical potential and current within a corona discharge region of operation by selecting a potential and current level as a function of said flow path geometry and the characteristics of the specific constituents of combustion employed, whereby said field causes a separation and flow of said electrons and ions and imparts them with sufficient energy to subsequently collide with other working fluid molecules creating a high concentration of molecular radicals to assure said ignition upon reaction with said other constituent molecular radicals.

2. The method of claim 1, wherein said region of intense electric field is established before said working fluid is exposed to said region.

3. The method of claim 1, wherein said region of intense electric field is established within said working fluid.

4. The method of 1, further comprising the step of removing said electrical potential from across said electrodes once self-sustaining combustion has been effected.

5. The method of claim 1, further comprising the step of establishing sources of fuel and oxidizing agent, said fuel and oxidizing agent constituting said constituents of combustion.

6. The method of claim 5, wherein said fuel is directed through said region and constitutes said working fluid.

7. The method of claim 5, wherein said oxidizing agent is directed through said region and constitutes said working fluid.

8. The method of claim 5, wherein said fuel and oxidizing agent are premixed and directed through said region and collectively constitute said working fluid.

* * * * *